United States Patent [19]

Mauer et al.

[11] Patent Number: 4,987,853

[45] Date of Patent: Jan. 29, 1991

[54] MAGNETIC BRUSH DEVELOPMENT APPARATUS

[75] Inventors: Richard Allen; Paul Hartley; Thomas Hilbert; Andrew Mauer; Thomas Stetz, all of Rochester, N.Y.

[73] Assignee: Eastman Kodak Company, Rochester, N.Y.

[21] Appl. No.: 280,068

[22] Filed: Dec. 5, 1988

[51] Int. Cl.[5] ..... G03G 15/09

[52] U.S. Cl. ..... 118/657; 355/251; 355/253

[58] Field of Search ..... 355/251, 253; 118/656, 118/657, 658

[56] References Cited

U.S. PATENT DOCUMENTS

| | | | |
|---|---|---|---|
| 3,939,801 | 2/1976 | Tanaka et al. | 118/658 |
| 4,292,925 | 10/1981 | Terashima | 118/690 |
| 4,559,899 | 12/1985 | Kan et al. | 118/657 |
| 4,614,419 | 9/1986 | Patz | 355/3 DD |
| 4,671,207 | 6/1987 | Hilbert | 118/657 |
| 4,705,383 | 11/1987 | Hiraga et al. | 355/3 DD |

FOREIGN PATENT DOCUMENTS

| | | | |
|---|---|---|---|
| 0116371 | 7/1982 | Japan | 355/251 |
| 0116374 | 7/1982 | Japan | 118/657 |
| 0028766 | 2/1983 | Japan | 355/251 |
| 0005267 | 1/1986 | Japan | 355/251 |
| 0229472 | 9/1988 | Japan | 355/251 |

*Primary Examiner*—R. L. Moses
*Assistant Examiner*—Robert Beatty
*Attorney, Agent, or Firm*—Lawrence P. Kessler

[57] ABSTRACT

Magnetic brush development apparatus for applying developer material to a latent electrostatic image in which flow of developer material, distributed in balance across the length of the apparatus, is assured. The apparatus includes a housing having a portion defining a sump adapted to contain a supply of developer material. A magnetic brush is located substantially within the housing in spaced relation to the sump portion for applying developer material to the latent image. A feed mechanism, located within the housing between the sump portion and the magnetic brush transports developer material from the sump to the magnetic brush. An agitating and transporting mechanism, located in said sump portion, agitates developer material and transports developer material to the feed mechanism. In the preferred embodiment the agitating and transporting mechanism is a ribbon blender. In order to assure the desired balanced developer material distribution in the apparatus housing under all conditions, a magnet is attached to the external wall of the housing adjacent to the sump portion.

4 Claims, 2 Drawing Sheets

MAGNETIC BRUSH DEVELOPMENT APPARATUS

BACKGROUND OF THE INVENTION

The present invention relates in general to magnetic brush development apparatus for applying developer material to a latent image in an electrostatographic reproduction apparatus, and more particularly to an improved magnetic brush development apparatus including a device for assuring substantially balanced developer material flow distribution in such apparatus.

Magnetic brush development apparatus for applying developer material to a latent image in an electrostatographic reproduction apparatus are well known in the art. Such apparatus may include a housing having a sump portion which contains a supply of developer material. When the developer material comprises a mixture of carrier particles and smaller pigmented marking particles, the material in the sump is agitated to triboelectrically charge the material prior to delivering it to a magnetic brush where it can be brought into association with, and electrostatically transferred to, an electrostatic latent image to develop such image.

Copending, commonly assigned U.S. Pat. application Ser. No. 597,323, now U.S. Pat. No. 4,887,132, filed April 6, 1984 in the names of Joseph et al, and U.S. Pat. No. 4,671,207, issued June 9, 1987, in the name of Hilbert disclose magnetic brush development apparatus particularly suitable for use with development material having pigmented marking particles and permanent magnetic carrier particles, such as disclosed in U.S. Pat. No. 4,546,060, issued Oct. 8, 1985, in the names of Miskinis et al. More particularly, the disclosed apparatus include a ribbon blender that is used for agitating (mixing), feeding and triboelectrically charging such material in the sump portion of a magnetic brush development apparatus, and a feed mechanism that delivers material from the sump portion to a magnetic brush. The ribbon blender is constructed to provide uniform flow distribution of developer material across the length of the apparatus so that a sufficient supply of material is delivered to the magnetic brush over its full extent to develop the entire latent electrostatic image. It has been found that under certain conditions developer material tends to pump toward one end of the apparatus. Accordingly, insufficient material is delivered to areas of the magnetic brush to satisfactorily develop the entire latent electrostatic image creating copy defects such as voids or under developed regions. Such conditions causing developer material pumping result from a variety of diverse parameters which include for example sump wall smoothness and developer material charge-to-mass ratio.

SUMMARY OF THE INVENTION

This invention is directed to an improved magnetic brush development apparatus for applying developer material to a latent electrostatic image wherein flow of developer material, distributed in balance across the length of the apparatus, is assured. The apparatus includes a housing having a portion defining a sump adapted to contain a supply of developer material. A magnetic brush is located substantially within the housing in spaced relation to the sump portion For applying developer material to the latent image. A feed mechanism, located within the housing between the sump portion and the magnetic brush transports developer material from the sump to the magnetic brush. An agitating and transporting mechanism, located in said sump portion, agitates developer material and transports developer material to the feed mechanism. In the preferred embodiment the agitating and transporting mechanism is a ribbon blender. In order to assure the desired balanced developer material flow distribution in the apparatus housing under all conditions, a magnet is attached to the external wall of the housing adjacent to the sump portion.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
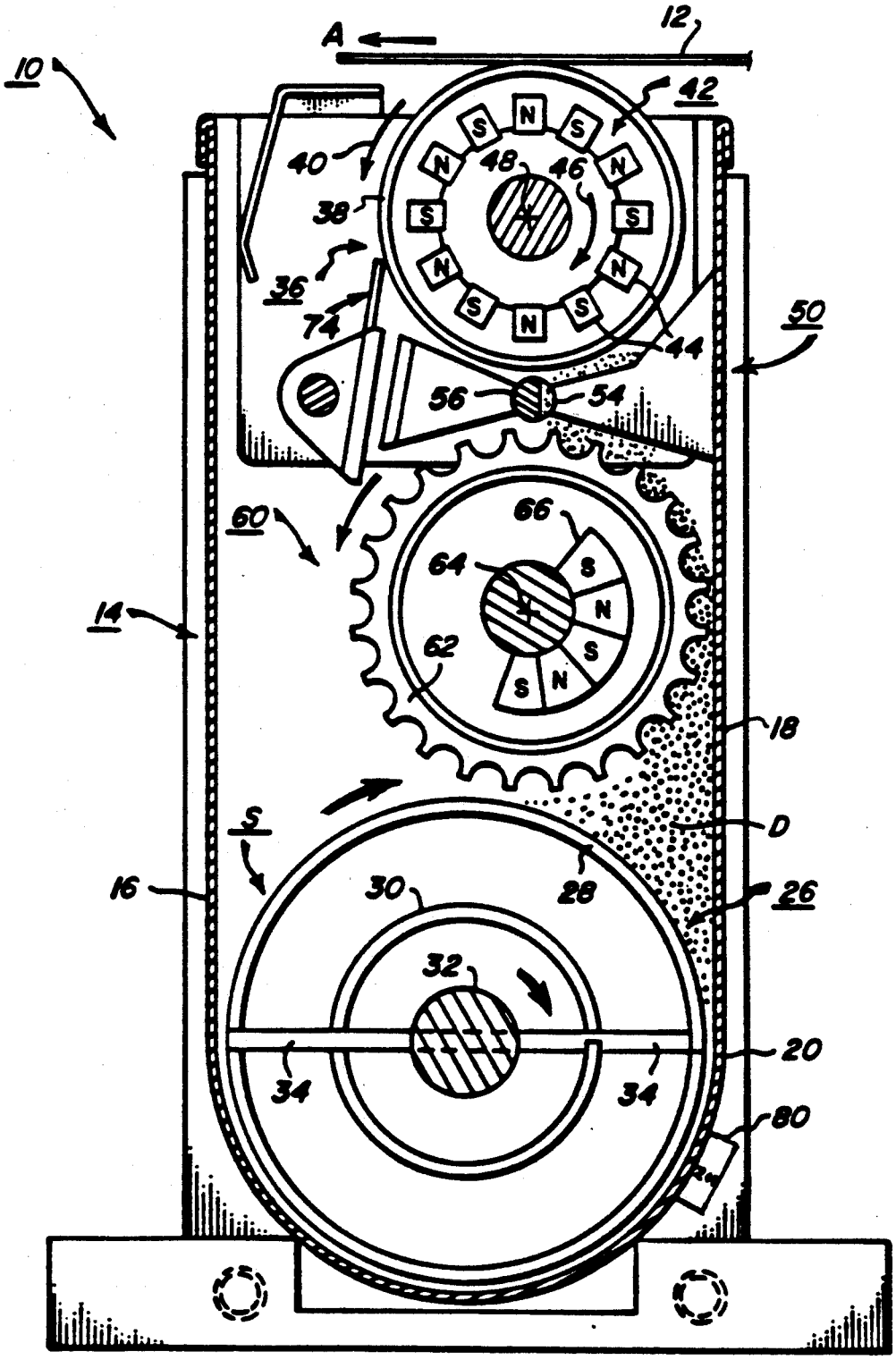
FIG. 1 is an end elevational view, partly in cross-section, of magnetic brush development apparatus of the present invention.
Figure 2:
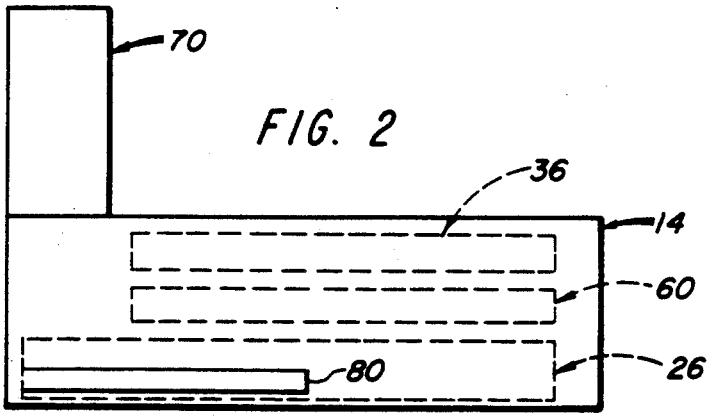
FIG. 2 is a side elevational view of the magnetic brush development apparatus shown in FIG. 1.

Referring now to the accompanying drawings, FIGS. 1 and 2 show a magnetic brush development apparatus according to this invention, generally designated by the numeral 10. The apparatus 10 is adapted to provide a supply of developer material, including pigmented marking particles, to an electrostatic latent image carried by a member 12 in order to develop the latent image on the member. The member 12, which is for example part of an electrostatographic reproduction apparatus, is in the form an endless web or a drum, or can be discrete sheets on which a copy is formed. The member 12 is moved past apparatus 10 in the direction shown by the arrow A during development of the latent image on the member.

Apparatus 10 comprises a housing 14 having spaced and generally parallel vertical side walls 16, 18, a generally semi-cylindrical bottom wall 20 that joins the side walls, and end walls. The lower portion of the housing defines a sump S for containing a supply of developer material D. Developer material D can be of any known type, for example including two-component developer materials wherein the two-component developer materials have hard, permanent magnetic carrier particles and pigmented marking particles as disclosed in the aforementioned U.S. Pat. No. 4,546,060.

Developer material D in sump S is agitated in order to provide triboelectric charging of the developer material, move the material along the length of the sump, and deliver developer material to a feed mechanism 60. Such agitation is effected by a ribbon blender generally designated by the numeral 26, such as disclosed in the aforementioned U.S. patent application Ser. No. 597,323, now U.S. Pat. No. 4,887,132, or U.S. Pat. No. 4,671,207. The ribbon blender 26 comprises an outer helical ribbon 28 and an inner helical ribbon 30. Both ribbons are coiled concentrically about a shaft 32. Shaft 32 is, in turn, concentrically located with respect to the semi-cylindrical bottom wall 20 of the housing 14, and runs for substantially the full length thereof. A plurality of rods 34 project from shaft 32. The ribbons 28, 30 are attached to the rods so that the ribbons rotate with the shaft 32. Ribbon 28 may have the same pitch throughout its length, or may have one pitch over half its length and the opposite pitch over the other half of its length. The pitch orientation of ribbon 30 is selected to be opposite to the pitch orientation of ribbon 28. When the shaft 32 is rotated in a clockwise direction as viewed in FIG. 1, the ribbons drive developer material D in sump S in a direction from the front of the housing 14 toward the rear, and then from the rear of the housing toward the front. This results in significant agitation and shearing of the developer material in order to triboelectrically charge the material.

A magnetic brush, generally designated by the numeral 36, is located at the top of housing 14. The magnetic brush 36 may be of any suitable construction, such as illustrated for example in FIG. 1 where the magnetic brush includes a shell 38 of a non-magnetic material that rotates counterclockwise as indicated by arrow 40 about a core 42. Core 42 comprises a plurality of permanent magnets 44 rotatable in a clockwise direction as shown by arrow 46. The axis of rotation of the core, coincident with the axis of rotation of the shell, is designated generally by the numeral 48. A portion of the magnetic brush 36 projects through the top of the housing 14 and lies directly underneath the electrostatic latent image carrying member 12.

Immediately beneath the magnetic brush 36 is a metering assembly 50 including an elongate, generally cylindrical feed slot 54 that extends substantially the full length of the magnetic brush and lies adjacent to the outer surface of the magnetic brush shell 38. Developer material D received from the lower portion of the housing 14 passes through slot 54 to the brush 36, such material being attracted to the outer surface of shell 38 by the magnets 44 in the core of the magnetic brush. Flow of developer material D through slot 54 is controlled by a rod 56 having a D-shaped portion located within slot 54. The rod is mounted so that it can be selectively rotated about its axis to a position (shown in FIG. 1) where material D can flow through slot 54 to the magnetic brush 36, or to a position where slot 54 is substantially closed to prevent the passage of developer material to the magnetic brush.

A feed mechanism generally designated by the numeral 60 is located between metering assembly 50 and the ribbon blender 26. Feed mechanism 60 receives developer material D driven from the sump S by the ribbon blender 26 and transports such material to the metering assembly 50 and through the slot 54 to the magnetic brush 36. Feed mechanism 60 comprises a shell 62 rotatable in a counterclockwise direction about an axis designated by the numeral 64. Within the shell 62 there are a plurality of stationary magnets 66 that extend about 160 degrees counterclockwise from a position generally directly above the ribbon blender 26 to a position just ahead of the feed slot 54. Developer material from the sump is attracted to the shell 62 and held to the shell in the area under the influence of the magnets 66. Thus the material can be transported from the sump to the slot 54 without dropping from the shell.

In operation, developer material provided to the magnetic brush 36 is used for developing an electrostatic latent image on the image bearing member 12 in a development zone between the brush and the member. After development of the latent image, continued rotation of the shell 38 of the magnetic brush brings the developer material remaining on the brush to a wiper 74 that scrapes the material from the shell. The removed material returns by gravity to the sump S where it is remixed by the ribbon blender 26 with developer material D remaining in the sump. Since material returned from the brush will be partially depleted of marking particles, fresh marking particles are periodically provided to the sump S by a marking particle replenishment mechanism 70 located at one side of the housing 14, above an end of the ribbon blender 26 (see FIG. 2).

Figure 3:
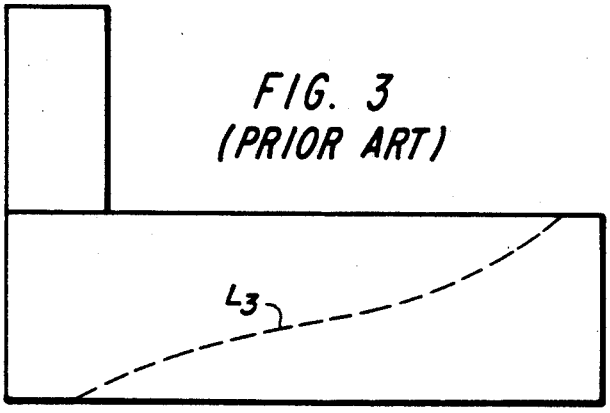
FIG. 3 (PRIOR ART)
FIGS. 3 and 4 are generally schematic side elevational views of prior art magnetic brush development apparatus, with portions removed to facilitate viewing, showing non-uniform developer material flow distribution.
Figure 4:
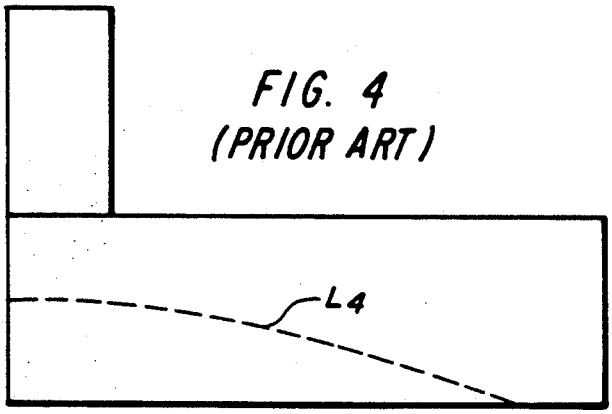
FIG. 4 (PRIOR ART)
Figure 5:
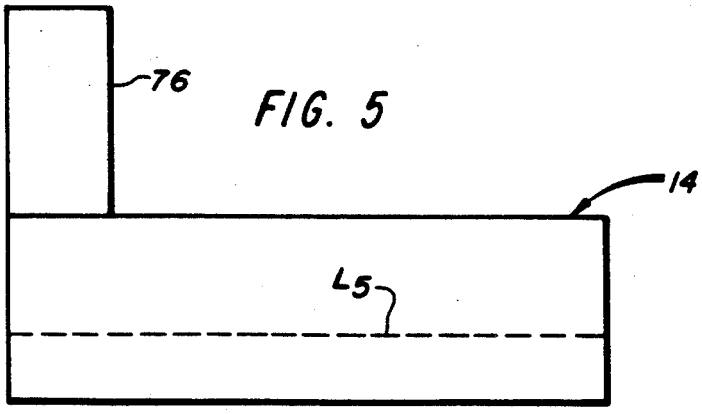
FIG. 5 is a generally schematic side elevational view of the magnetic brush development apparatus according to this invention, with portions removed to facilitate viewing, showing uniform developer material flow distribution.

As noted above, in prior magnetic brush development apparatus employing ribbon blenders there is a tendency under certain circumstances for the blender to pump developer material toward one end of the apparatus (see prior art FIGS. 3 and 4 wherein developer material level is designated respectively $L_3$ and $L_4$). The non-uniform distribution of developer material resulting from this pumping action causes insufficient material to be delivered to the full extent of the magnetic brush to satisfactorily develop an entire latent electrostatic image. In order to substantially prevent this undesirable pumping action, a magnet 80 is attached externally to the front side of the housing 14 opposite the sump S adjacent to the area where wall 18 joins wall 20. Thus, the magnet 80 is located substantially upstream of the feed mechanism with respect to the direction of transport of the developing material from the agitating and transporting means to the feed mechanism. The magnet is of a length, in the direction of the ribbon blender, of at least approximately equal to one-half the length of the blender, and produces a magnetic field sufficient to interfere with the flow action in the developer material induced by the blender, yet not so strong so as to disrupt overall apparatus operation flow. That is to say, the field of the magnet 80 attracts developer material toward the magnet, thus somewhat inhibiting its flow by the outer helical ribbon 28 in order to tune the steady state flow balance in the developer apparatus (see FIG. 5 wherein developer material level is designated $L_5$). The end result is that any abnormal flow of developer material is substantially evened out whereby a uniform distribution of material flow is provided to the magnetic brush for satisfactory development of entire latent electrostatic images. For example, in a magnetic brush development apparatus of approximately 56 cms. in length, the magnet is of a length of at least 28 cms. and of a strength of approximately 450–500 surface gauss.

The invention has been described in detail with particular reference to a preferred embodiment thereof, but it will be understood that variations and modifications can be effected within the spirit and scope of the invention as described hereinabove and as defined in the appended claims.

We claim:

1. Magnetic brush development apparatus for applying developer material to a latent image, said apparatus comprising:

a housing having a portion defining a sump adapted to contain a supply of developer material;

a magnetic brush, located substantially within said housing in spaced relation to said sump portion, for applying developer material to a latent image;

a feed mechanism located within said housing between said sump portion and said magnetic brush for transporting developer material from said sump portion to said magnetic brush;

means, located in said sump portion, for agitating developer material and transporting developer material to said feed mechanism; and a stationary magnet attached to the external wall of said housing adjacent to said sump portion substantially upstream of said feed mechanism with respect to the direction of transport of said developing material from said agitating and transporting means to said feed mechanism, the field of said magnet being oriented to act on developer material being agitated and transported by said agitating and transporting means to balance developer material flow distribution from front to rear in said housing.

2. The invention of claim 1 wherein said agitating and transporting means includes a ribbon blender.

3. The invention of claim 2 wherein said magnet is of a length, in the direction of the longitudinal axis of said ribbon blender, approximately equal to at least one-half the length of said ribbon blender.

4. The invention of claim 3 wherein said magnet is of a strength of approximately 450–500 surface gauss.

* * * * *